United States Patent [19]

Gellert

[11] Patent Number: 4,969,615

[45] Date of Patent: Nov. 13, 1990

[54] DELTA SQUARED KITE

[76] Inventor: Donald P. Gellert, Birchwood #9, South Down Shores, Laconia, N.H. 03246

[21] Appl. No.: 487,667

[22] Filed: Mar. 2, 1990

[51] Int. Cl.[5] ..... A63H 27/08

[52] U.S. Cl. ..... 244/153 R; 244/901; D21/88

[58] Field of Search ..... 244/153 R, 154, 901; D21/88

[56] References Cited

U.S. PATENT DOCUMENTS 2,508,747 5/1950 Cox ..... 244/153 R

FOREIGN PATENT DOCUMENTS 2270145 12/1975 France ..... 244/901

OTHER PUBLICATIONS

David Pelham, "The Penguin Book of Kites", © 1976, p. 157.

*Primary Examiner*—Joseph F. Peters, Jr.
*Assistant Examiner*—Christopher P. Ellis
*Attorney, Agent, or Firm*—Michael J. Weins

[57] ABSTRACT

The present invention is for a kite which in its simplest form has a first edge spar and second edge spar which are equal in length and attaching to a flexible coupling such that when the coupling is in its neutral position the attached spars are substantially orthogonal. A header spar shorter than the first edge spar and the second edge spar engages the flexible coupling such that at the rest position the angle between the first edge spar and the header spar is equal to the angle between the second edge spar and the header spar. A sail covering the spars forms a central delta sail surface with a first triangular elevator panel and a second triangular elevator panel attached thereto. The first and second edge spars bound two sides of the central delta sail surface. The first and second triangular elevator panels have one of their sides bounded by an edge spar and a second side bounded by the header spar. The spars attached to the flexible coupling allows the central delta sail surface to respond to changes in the wind by providing a self reefing sail. This self reefing sail and triangular elevators provide stability and controllability.

6 Claims, 2 Drawing Sheets

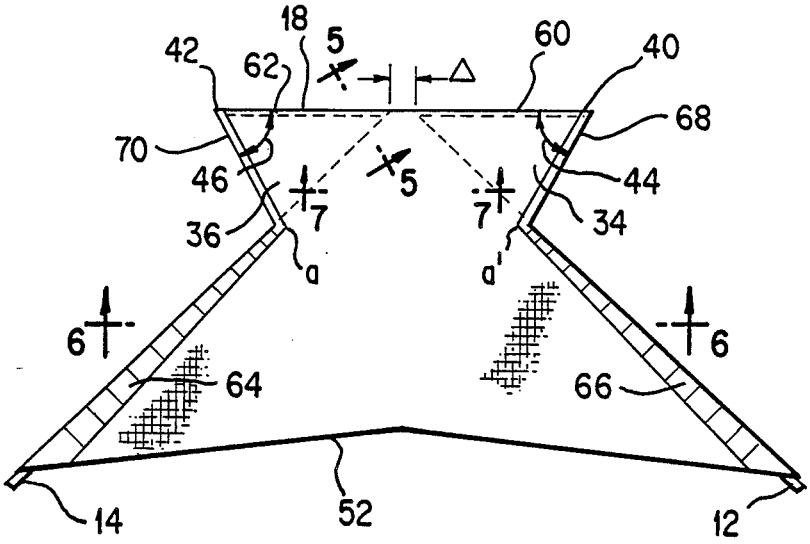
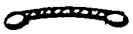
FIG. 5
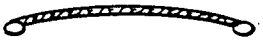
FIG. 7
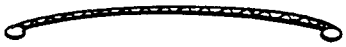
FIG. 6
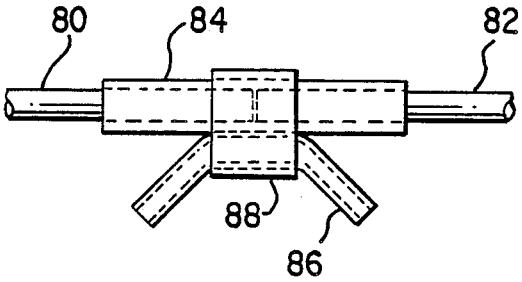
FIG. 8

DELTA SQUARED KITE

FIELD OF INVENTION

The present invention is directed to a kite and more particularly to a delta kite.

BACKGROUND ART

Kite flying has long been a source of entertainment. The early records of kite flying date back to the Chinese in the 3rd century, B.C.

Over the years both kite designs and methods for flying have changed. Classic kites have a series of spars which form a rigid frame attached to a sail creating an air foil.

For delta kites structural rigidity of the frame has been maintained by a series of spars which are pinned together to produce a triangular truss. The sail supported by this structure provides an air foil that is very sensitive to changes in the wind conditions and thus difficult to control. Furthermore if control is lost the rigid frame is hazardous to itself and to objects which it impacts.

Thus there is a need for a flexible, user-friendly delta kite that provides maneuverability of a delta kite with less sensitivity to wind changes and avoids the inherent hazards associated with rigid frames.

SUMMARY OF THE INVENTION

It is an object of the present invention to provide a kite with floating spars supporting the sail surface thereby creating a self reefing sail.

It is another object of the invention to provide a sail that self-reefs accommodating to wind changes.

It is still a further object of the invention to provide a modified delta kite with a flat rather than a pointed leading edge, thereby minimizing damages that might result on impact.

Still another object of the present invention is to provide stabilizing elements which enhance the glide characteristics of the kite by minimizing stall characteristics of the kite.

Yet another object of the invention is to provide a modified delta kite with fewer parts thereby reducing the mass as compared to comparable kites of similar size.

These and other objects of the invention will be apparent from the following description, figures and claims.

The kite of the present invention in its simplest form has a first edge spar and second edge spar which are equal in length and attaching to a flexible coupling. It is preferred that the coupling is attached to the first and second edge spar such that when the coupling is in its neutral position the attached spars are substantially orthogonal. This restriction assures maximum sail area for minimum spar length.

A header spar shorter than the first edge spar and the second edge spar engages the flexible coupling such that at the rest position the angle between the first edge spar and the header spar is equal to the angle between the second edge spar and the header spar. It is preferred that the header spar be not greater in length than about three fourths of the length of the edge spars.

A sail covering the spars forms a central delta sail surface with a first triangular elevator panel and a second triangular elevator panel attached thereto. The first and second edge spars bound two sides of the central delta sail surface. The first triangular elevator panel has one of its sides bounded by the first edge spar and a second side bounded by the header spar. The second triangular elevator panel has one side bounded by the second edge spar and a second side bounded by the header spar.

The triangular elevator panels are configured with free vertexes that are opposite the first edge spar and the second edge spar. These vertexes have an included angle of not greater than about 90 Deg. Preferably these angles are between about 60–63 Deg.

BRIEF DESCRIPTION OF THE DRAWINGS

FIG. 4 illustrates a kite of the present invention with tension members connecting the first and second edge spars to the header spar.

FIG. 5 is a section 5–5 of FIG. 4 which illustrates the profile of the elevator panel when filled.

FIG. 6 is a section 6–6 of FIG. 4 which illustrates the profile of the trailing section of the central delta sail when filled.

FIG. 7 is a section 7–7 of FIG. 4 which illustrates the profile of the trailing section of the central delta sail when filled.

FIG. 8 illustrates another embodiment of the kite of the present invention where the header spar has two sections connected by a rigid coupler. The sectional header spar allows the kite to be collapsed for storage.

BEST MODE FOR CARRYING THE INVENTION INTO PRACTICE

Figure 1:
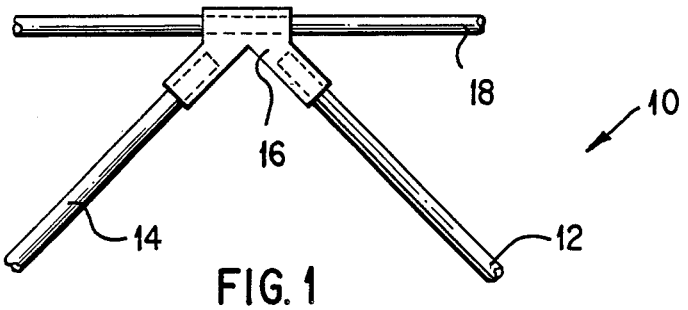
FIG. 1 illustrates a frame for one embodiment of the present invention showing the spars and their placement with respect to the flexible coupling.

FIG. 1 illustrates the spar configuration for one embodiment of the present invention. The kite frame 10 has a first edge spar 12 and a second edge spar 14. These spars are the same length. The first edge spar 12 and the second edge spar 14 are attached to by a flexible coupling 16. The flexible coupling allows the first edge spar 12 and the second edge spar 14 to move or float relative to each other. The coupling when in its neutral position maintains the first edge spar 12 substantially orthogonal to the second edge spar 14. The neutral position for the coupling is defined as the unstressed coupling configuration. It is preferred that the angle included between the first and the second spar be about 90 Deg., since this angle provides the maximum sail area with the minimum spar length.

A header spar 18 which is shorter than the first edge spar 12 and the second edge spar 14 is attached to the flexible coupling 16.

Figure 2:
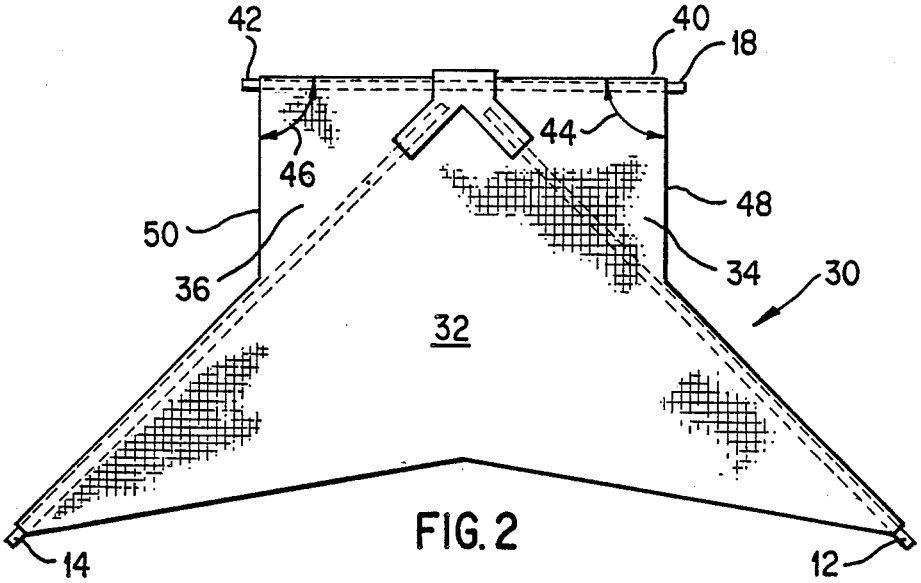
FIG. 2 illustrates a sail configuration for one embodiment of the kite of the present invention.

FIG. 2 illustrates one sail configuration for the kite frame 10 of FIG. 1. A sail 30 covers the frame 10 of the kite creating a central delta sail surface 32, with first triangular elevator panel 34 and a second triangular elevator panel 36. The central delta sail surface 32 is bounded on one side by the first edge spar 12 and on a second side by the second edge spar 14. The first triangular elevator panel 34 is bounded on one side by the first edge spar 12 and on a second side by the header spar 18. The second triangular elevator panel 36 is bounded on one side by the second edge spar 14 and a second side by the header spar 18.

Preferably the ratio of the length (L) of the first edge spar 12 and second edge spar 14 to the length (1) of the header spar 18 (1/L) is greater than ½ and less than ¾. This provides elevator panels (34 and 36) which will be of sufficient size to stabilize the delta while assuring that elevators avoid becoming controlling surfaces that destabilize the central delta sail surface 32 when the kite is in flight. This ratio will also avoid the kite from becoming nose heavy and causing the kite to dive.

The first triangular elevator panel 34 has a first panel free vertex 40 which is opposite the first edge spar 12. Similarly the second elevator panel 36 has a second panel free vertex 42 which is opposite the second edge spar 12. These vertexes have included vertex angles (44 and 46) which are not greater than about 90 Deg. If the angle becomes greater than about 90 Deg. then the respective free edges 48 and 50 of the triangular elevator surfaces (34 and 36) tend to flutter creating an instability in the triangular elevator surfaces (34 and 36).

Figure 3:
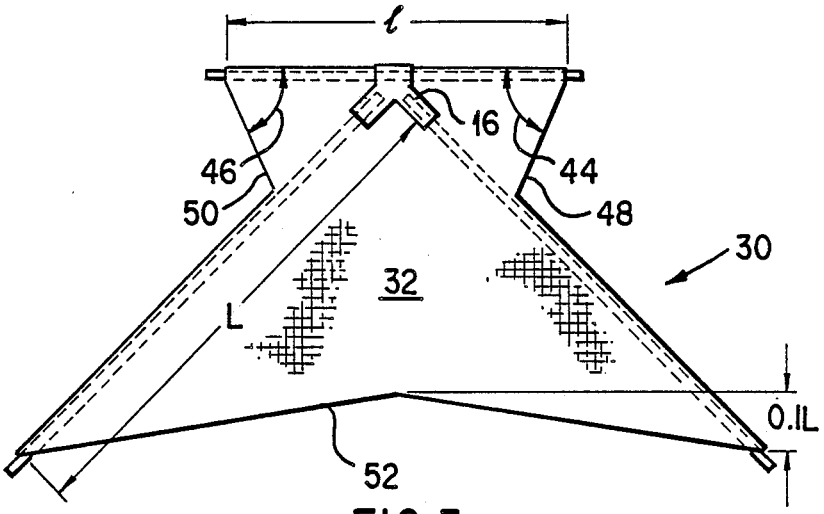
FIG. 3 is a preferred sail configuration for the kite of the present invention.

FIG. 3 illustrates a preferred sail configuration for the kite of the present invention. In this configuration the vertex angles (44 and 46) are between about 60–63 Deg. This configuration assures that the free edges will not be subject to flutter and in combination with the restriction on the ratio of spar sizes elevator size will maintain optimum balance between the central delta sail area and the elevators.

The sail 30 may be attached to the frame by a variety of means. For example, the frames may be adhesively bonding the skin 30 to the frame 10 or the spars may be sewed into seams. The latter method allows the spars to be removed for storage or for replacement of damaged spars.

It is further preferred that trailing edge 52 of the delta surface 32 be contoured such that the center of the trailing edge is displaced toward the flexible coupling 16 by about 0.1 L. This displacement reduces the turbulance which is generated along the trailing edge that occurs in a delta wing.

FIG. 4 illustrates a kite with let-out panels and tension members. Let-out panels are provided to the sail which allow the sail to fill and form conical surfaces during flight. The let-out panels are preferably triangular extensions to the sail. A first elevator let-out panel 60 and a second elevator let-out panel 62 are provided along the header 18 having their vertex at the midpoint of the header 18. Additional let-out panels are provided for the central delta sail. A first delta sail let-out panel 64 and a second central delta sail let-out panel are provided along the edge spars. These delta panels initiate at the lowest extremities of the triangular elevator panels terminate with the trailing edge 52 of the central delta sail surface 32. The spars 14 and 12 are affixed to the sail edged at points a and a'. The pinning of the spars to the delta sail surface at a and a' assures that the curvature of the sail at cross section 7—7.

The contour along section 5—5 of the elevator panel is shown in FIG. 5 with the panel filled forming a conical surface. The contour along section 6—6 is shown in FIG. 6 with the central delta sail surface filled and illustrates the resulting conical surface.

Tension members (18 and 70) shown in FIG. 4 improve the stability of the resulting kite structure. A first tension member 68 is attached to the first panel free vertex 40 and to the first spar 12 at the point of termination of the first triangular elevator panel 34. A second tension member 70 is attached to the second panel free vertex 42 and to the second spar 14 at the point of termination of the second triangular elevator panel 36. These tension members can be for example cords or wires. The tension members assure a constant air foil section regardless of the modifications of the angle between the first spar 12 and the second spar 14 by the wind.

It is further preferred that the first spar 12 and the second spar 14 are separated by delta at the header spar 18. This increases the effective sail area of the central delta sail 32. This separation of delta should be less than about 20% of the length of the header spar 18 to maintain elevator panels of sufficient size to stabilize the kite.

While it is desirable to provide the ability to allow the angle to vary between the first spar 12 and the second spar 14 to provide a self-reef central delta sail surface during operation, it is preferred that tension members be employed to provide dampening means with respect to the response of the spars to the wind and also assure that the elevator panels do not become taut and thus preserves the conical surface of the elevators during flight. FIG. 8 illustrates another embodiment wherein the header spar is divided into a first section 80 and a second section 82. The sections are joined by a rigid coupling 84. Preferably the coupling length is at least 6 times the diameter of the spars to assure the rigid positioning of the spars in the coupling. The spars are held in position by providing a frictional fit the spars (82 and 84) and the rigid coupling 84. The rigid coupling 84 attaches to the flexible coupling 86 by a band 88, providing the structure equivalent to the frame 10 of FIG. 1. This embodiment provides for disassembly of the kite for storage or transportation.

What I claim is:

1. A kite comprising:

a first edge spar;

a second edge spar, said first edge spar and said second edge spar having a length L;

a flexible coupling floatably connecting said first and said second edge spars, said coupling positioning said first edge spar with said second edge spar such that the angle there between is substantially normal when said flexible coupling is in its neutral position;

a header spar having a length(1) such that (1/L) is less than about 0.75, said header spar being attached to said flexible coupling such that the angles said header spar makes with said first edge spar and said second edge spar are equal; and a sail covering said spars forming a delta sail surface bounded on a first side by said first edge spar and on a second side by said second edge spar, a first triangular elevator panel bounded on one side by said header spar and on a second side by said first edge spar, and a second triangular elevator panel bounded on one side by said header spar and a second side by said second edge spar.

2. The kite of claim 1 wherein said first elevator panel has a first free vertex opposite said first spar and said second elevator panel has a second free vertex opposite said second spar, said first vertex and said second vertex having included angles less than or equal to about 90 deg.

3. The kite of claim 2 wherein said included angles are between 60 and 63 degrees and the (1/L) ratio is greater than 0.5.

4. The kite of claim 2 further comprising:

elevator let-out panels and central delta sail let-out panels.

5. The kite of claim 4 further comprising:

a first tension member connecting said first panel free vertex to said first edge spar at the point of termination of said first triangular elevator; and a second tension member connecting said second panel free vertex to said second edge spar at the point of termination of said second triangular elevator.

6. The kite of claim 1 wherein said header spar has a first section and a second section connected by a rigid coupler, said coupler attaching to said flexible member.

* * * * *